US007427120B2

(12) United States Patent
Ebihara

(10) Patent No.: US 7,427,120 B2
(45) Date of Patent: Sep. 23, 2008

(54) RECORDING-DENSITY CONTROL METHOD OF IMAGE RECORDING APPARATUS

(75) Inventor: Toshiyuki Ebihara, Tokyo (JP)

(73) Assignee: Olympus Corporation, Tokyo (JP)

( * ) Notice: Subject to any disclaimer, the term of this patent is extended or adjusted under 35 U.S.C. 154(b) by 93 days.

(21) Appl. No.: 11/637,829

(22) Filed: Dec. 12, 2006

(65) Prior Publication Data

US 2007/0139456 A1 Jun. 21, 2007

(30) Foreign Application Priority Data

Dec. 15, 2005 (JP) ..... 2005-361866

(51) Int. Cl.
*B41J 29/393* (2006.01)

(52) U.S. Cl. ..... 347/19

(58) Field of Classification Search ..... 347/16, 347/19, 101, 105, 12, 40, 43, 15, 9
See application file for complete search history.

(56) References Cited

U.S. PATENT DOCUMENTS 4,435,634 A * 3/1984 Horlander ..... 347/209
6,020,976 A 2/2000 Fujita et al.
2002/0149635 A1 * 10/2002 Askeland et al. ..... 347/9

FOREIGN PATENT DOCUMENTS

JP 10-44519 A 2/1998

* cited by examiner

*Primary Examiner*—Lamson Nguyen
(74) *Attorney, Agent, or Firm*—Frishauf, Holtz, Goodman & Chick, P.C.

(57) ABSTRACT

A recording-density control method of an image recording apparatus for performing image recording by arranging, a nozzle array component arranged in a plural number comprising a plurality of nozzles for discharging uniform-color ink. A test recording is performed on the recording medium by N number of the nozzle array components arranged in a plural number. In the test recording, a driving parameter for driving the second nozzle array component is determined from a recording density of the recording medium used for the test recording by nozzles located at a contact edge of the first nozzle array component and the second nozzle array component. A recording density is estimated at the edge of an $n_{th}$ nozzle array component that is in contact with the $n+1^{th}$ nozzle array component for the N number of nozzle array components driven by the determined driving parameter, and a driving parameter for driving the $n+1^{th}$ nozzle array component is determined.

12 Claims, 16 Drawing Sheets

| CORRECTION VOLTAGE (V) | SCANNER OUTPUT VALUE (D) |
|---|---|
| -2.0 | 79.9 |
| -1.9 | 79.3 |
| -1.8 | 78.8 |
| -1.7 | 78.3 |
| -1.6 | 77.8 |
| -1.5 | 77.3 |
| -1.4 | 76.8 |
| -1.3 | 76.3 |
| -1.2 | 75.8 |
| -1.1 | 75.3 |
| -1.0 | 74.9 |
| -0.9 | 74.4 |
| -0.8 | 74.0 |
| -0.7 | 73.5 |
| -0.6 | 73.1 |
| -0.5 | 72.6 |
| -0.4 | 72.2 |
| -0.3 | 71.8 |
| -0.2 | 71.4 |
| -0.1 | 71.0 |
| 0.0 | 70.6 |
| 0.1 | 70.2 |
| 0.2 | 69.8 |
| 0.3 | 69.4 |
| 0.4 | 69.1 |
| 0.5 | 68.7 |
| 0.6 | 68.3 |
| 0.7 | 68.0 |
| 0.8 | 67.7 |
| 0.9 | 67.3 |
| 1.0 | 67.0 |
| 1.1 | 66.7 |
| 1.2 | 66.4 |
| 1.3 | 66.1 |
| 1.4 | 65.8 |
| 1.5 | 65.5 |
| 1.6 | 65.2 |
| 1.7 | 64.9 |
| 1.8 | 64.6 |
| 1.9 | 64.4 |
| 2.0 | 64.1 |

F I G. 7

FIRST NOZZLE ARRAY COMPONENT

| DENSITY VALUE OF LEFT EDGE | CORRECTION VOLTAGE | DENSITY VALUE OF RIGHT EDGE |
|---|---|---|
| — | 0V | 68.5 |

SECOND NOZZLE ARRAY COMPONENT

| DENSITY VALUE OF LEFT EDGE | CORRECTION VOLTAGE | DENSITY VALUE OF RIGHT EDGE |
|---|---|---|
| 70.4 | 0V | 67.9 |

THIRD NOZZLE ARRAY COMPONENT

| DENSITY VALUE OF LEFT EDGE | CORRECTION VOLTAGE | DENSITY VALUE OF RIGHT EDGE |
|---|---|---|
| 71.1 | 0V | — |

FIG. 12A

FIRST NOZZLE ARRAY COMPONENT

| DENSITY VALUE OF LEFT EDGE | CORRECTION VOLTAGE | DENSITY VALUE OF RIGHT EDGE |
|---|---|---|
| — | 0V | 68.5 |

SECOND NOZZLE ARRAY COMPONENT

| DENSITY VALUE OF LEFT EDGE | CORRECTION VOLTAGE | DENSITY VALUE OF RIGHT EDGE |
|---|---|---|
| 68.5 | 0.5V | 66.0 |

THIRD NOZZLE ARRAY COMPONENT

| DENSITY VALUE OF LEFT EDGE | CORRECTION VOLTAGE | DENSITY VALUE OF RIGHT EDGE |
|---|---|---|
| 71.1 | 0V | — |

FIG. 12B

FIRST NOZZLE ARRAY COMPONENT

| DENSITY VALUE OF LEFT EDGE | CORRECTION VOLTAGE | DENSITY VALUE OF RIGHT EDGE |
|---|---|---|
| — | 0V | 68.5 |

SECOND NOZZLE ARRAY COMPONENT

| DENSITY VALUE OF LEFT EDGE | CORRECTION VOLTAGE | DENSITY VALUE OF RIGHT EDGE |
|---|---|---|
| 68.5 | 0.5V | 66.0 |

THIRD NOZZLE ARRAY COMPONENT

| DENSITY VALUE OF LEFT EDGE | CORRECTION VOLTAGE | DENSITY VALUE OF RIGHT EDGE |
|---|---|---|
| 66.0 | 1.5V | — |

FIG. 12C

RECORDING-DENSITY CONTROL METHOD OF IMAGE RECORDING APPARATUS

CROSS REFERENCE TO RELATED APPLICATIONS

This application claims benefit of Japanese Application No. 2005-361866 filed Dec. 15, 2005, the contents of which are incorporated by this reference.

BACKGROUND OF THE INVENTION

1. Field of the Invention

The present invention relates to a recording-density control method for an image recording apparatus for recording images that controls recording density by having nozzle array components that are each made of a plurality of nozzles for discharging a uniform ink color.

2. Description of the Related Art

Image recording apparatuses such as printers and copying machines employ inkjet print recording, thermal recording, and thermal transfer recording.

Inkjet print recording uses a nozzle array component (recording head) having a plurality of nozzles arranged in an approximately linear manner for recording the recording dots.

One of the methods used by such image recording apparatuses is the full-line type method shown in FIG. 1.

The image recording apparatus in FIG. 1 has a nozzle array component (recording head) for creating a uniform color that is formed by nozzle array components (recording heads) 16*a*-16*f* being fixed and arranged by a carriage 15 so that each of the recording ranges are adjacent to each other or in a position in which a part of the range overlaps in the direction in which the recording medium 11 is being carried. The recording medium 11 to be recorded is carried in the direction indicated by the arrow 14 in FIG. 1 by a roller 13 that is driven by a motor 12, is at a position in which the medium 11 faces the ink discharging side of nozzle array components 16*a*-16*f*, and image data is separately recorded by nozzle array components 16*a*-16*f*.

Next, the nozzle array component (recording head) used in an image recording apparatus with such a configuration is explained.

FIG. 2A is a diagram that schematically shows a nozzle array component(recording head) from the ink discharge side.

In FIG. 2A, a plurality of nozzles 22 for discharging ink are arranged in an approximately linear manner over the width 23 on the ink discharging side 21.

In such a nozzle array component (recording head), the recording density characteristic may be different for each nozzle array component (recording head), or the recording density characteristic may depend on the position in which the plurality of nozzles 22 are arranged, as shown in FIG. 2B.

FIG. 2B shows a scanner output value (recording density) in a case in which image data with a uniform color and the same tone is recorded on a recording medium by a uniform driving signal (driving parameter) with all of the plurality of nozzles 22, and the recorded recording medium is read by a scanner. According to the recording density characteristic in FIG. 2B, there is a difference in the output values between the edge and center of the recording head; consequently, an uneven density exists in the recording result.

As technology for solving such a problem, Patent Document 1 (Japanese Patent Application Publication No. 10-44519) discloses a serial type inkjet image recording apparatus and image recording system for improving density unevenness caused by the difference in density characteristics of the recording head.

The image recording apparatus and image recording system comprise two recording heads, recording head A and a recording head B, arranged in a carriage with a prescribed amount of space between them. When recording on the recording medium by dividing the scanning areas by the two recording heads, corrections are made to signal values input into both of the recording heads so that the recording density produced by the recording head A and the recording density produced by the recording head B can be the same.

FIG. 3 shows a conventional method of controlling density differences for nozzle array components (recording head, in the case of the first through third recording heads in FIG. 3) in an image recording apparatuses such as the one shown in FIG. 1.

FIG. 3A shows output values (scanner output values) when recording image data on matter with a uniform color and tone by all nozzles of the first through third recording heads. In other words, FIG. 3A shows the density characteristics of the first through third recording heads. In FIG. 3A, the scanner output value is on the vertical axis, and the value becomes larger as the surface of the recorded matter becomes brighter (as reflectance on the recorded matter becomes higher).

In general, the scanner output values are low when the density value is high. In the following explanation, the scanner output values are employed as values indicating the density.

In order to match the density at the connections of the first through third recording heads, the density characteristic of each of the recording heads should be examined at the beginning of the process. The examination method should be such that a test recording of image data with a uniform color and tone is conducted by an image recording apparatus and the recording density of the recorded medium of the test recording is measured.

Accordingly, in the image recording apparatus with the first through third recording heads, in order to match the density of the second recording head adjacent to the first recording head designated to be a reference, a first test recording is conducted on the recorded medium.

Next, the recording density of the recorded medium of the test recording is measured by a scanner, and from the difference between the density of the right end of the first recording head and the density of the left end of the second recording head, the correction amount of a driving parameter of the second recording head (such as the application voltage/application time of each nozzle of the recording head) is calculated, and the correction is performed on the basis of the calculated value. As a result, the densities on the right end of the first recording head and the left end of the second recording head should match. FIG. 3B shows such a state.

Next, the image recording apparatus performs test recording again since the density characteristic of the second recording head changed with the above correction. The recording density of the recorded medium of the test recording is measured by a scanner, the correction amount of a driving parameter of the third head is calculated from the recording densities on the right end of the second recording head and the left end of the third recording head, and the correction is performed on the basis of the calculated value. As a result, on the right end of the second recording head and the left end of the third recording head, the densities should also match. FIG. 3C shows such a state.

Because there is in general a nonlinear relationship between the driving parameter and the recording density, after the correction of the second recording head adjacent to the first recording head designated to be a reference, the density of the other recording head cannot be controlled using the result in the conventional methods not employing the information.

In the image recording apparatus with the first through third recording heads, as shown in FIG. 3A through FIG. 3C, the correction amount can be calculated using only the above-explained procedures and correction processing can be performed because the connections of the three adjacent recording heads are matched.

However, in an image recording apparatus comprising a recording head discharging an ink of a uniform color with a larger number of recording heads, calculation of the correction amount corresponding to the number of recording heads has to be repeated.

SUMMARY OF THE INVENTION

The recording-density control method of the image recording apparatus according to the embodiment of the present invention is a recording-density control method of an image recording apparatus for performing image recording by arranging, in a direction approximately orthogonal to the direction in which a recording medium is carried, a nozzle array component comprising a plurality of nozzles for discharging a uniform-color ink. This method includes the performance of a test recording on the recording medium by N number (where N is an integer in which $N \geqq 3$) of nozzle array components arranged in a plural number; a determination of, as a control of a second nozzle array component adjacent to a first nozzle array component with the first nozzle array component serving as a reference in the N number of nozzle array components, a driving parameter for driving the second nozzle array component from a recording density of the recording medium used for the test recording by nozzles located on a contact edge of the first nozzle array component and the second nozzle array component; a estimation of a recording density of a edge of an $n^{th}$ nozzle array component (where n is an integer in which $n \geqq 2$) that is in contact with the $n+1^{th}$ nozzle array component from among the N number of nozzle array components driven by the determined driving parameter; and a determination of a driving parameter for driving the $n+1^{th}$ nozzle array component on a basis of the estimated recording density of the edge.

BRIEF DESCRIPTION OF THE DRAWINGS

FIG. 7 is a diagram showing the relationship between the correction voltage and the scanner output value by using average values;

FIGS. 12A, 12B and 12C are diagrams showing data of a density value on the left and the correction voltage and a density value on the right of each of the nozzle array components stored in the correction calculation unit;

DESCRIPTION OF THE PREFERRED EMBODIMENT

In the following description, details of the embodiment of the present invention are set forth with reference to the drawings.

FIG. 4 is a conceptual diagram showing the recording-density control method of the image recording apparatus of the embodiment of the present invention.

Figure 1:
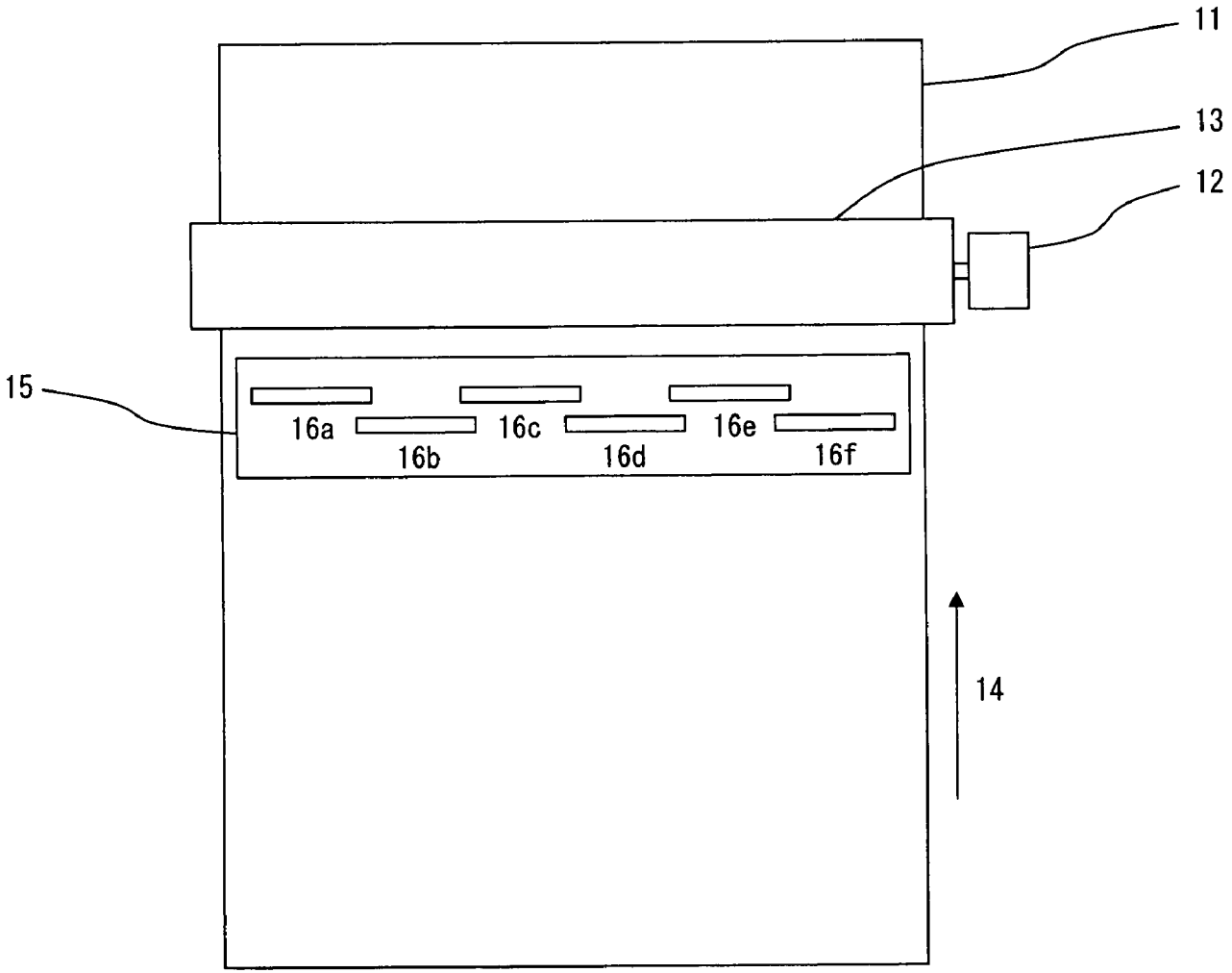
FIG. 1 is a diagram showing an example of the configuration of the full-line type image recording apparatus.
Figure 2A:
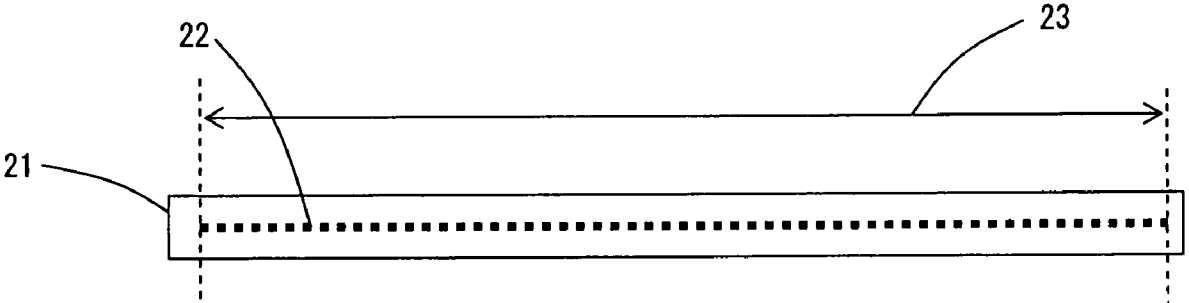
FIG. 2A is a diagram that schematically indicates a nozzle array component (recording head) from the ink discharge side.
Figure 2B:
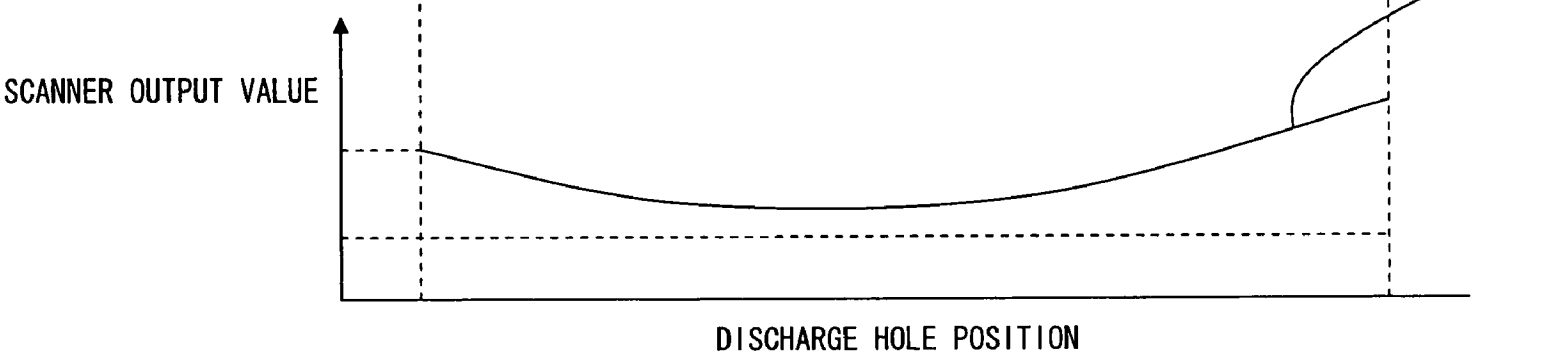
FIG. 2B is a graph showing a scanner output value in a case in which image data with a uniform color and the same tone recorded in a recording medium by a uniform driving signal is read by a scanner.
Figure 3B:
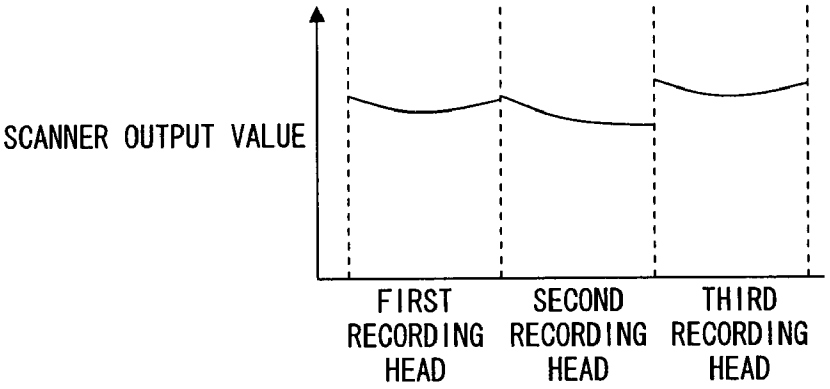
FIGS. 3A, 3B and 3C are diagrams explaining a conventional method of controlling density difference between a plurality of recording heads.
Figure 3A:
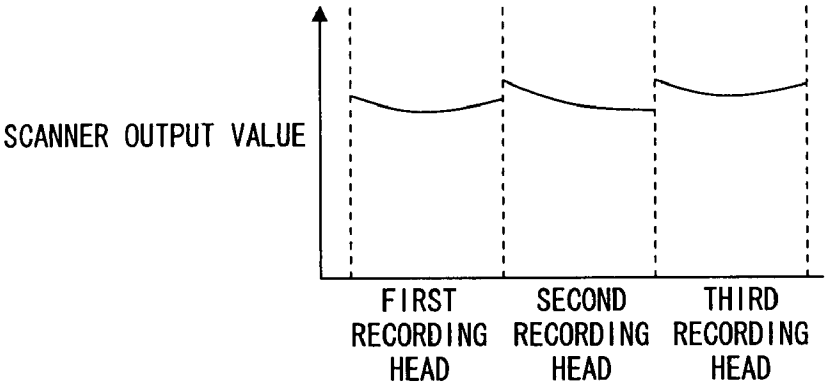
Figure 3C:
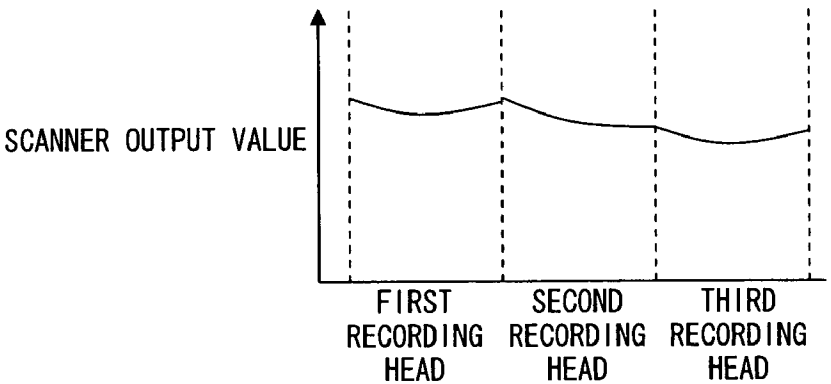
Figure 4A:
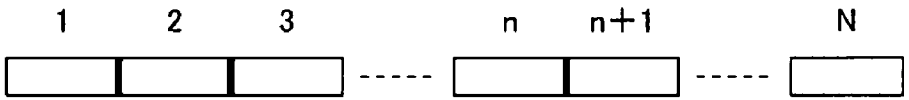
FIGS. 4A, 4B and 4C are diagrams conceptually showing the recording-density control method of the present invention.

FIG. 4A shows a recording control method in a case in which one nozzle array component (recording head) comprises a total number of N (where N is an integer) nozzle array components (recording heads), and it is a method in which the recording density of the second nozzle array component (left edge) is matched with the recording density of the first nozzle array component (right edge) as a reference of the left-edge first nozzle array component and, in succession, the recording density of the third nozzle array component (left edge) is matched with the recording density of the second nozzle array component (right edge).

As such a control method, in the conventional control method, test recording of image data with a uniform color and the same tone is performed by an image recording apparatus, and the recording density at the end of the reference nozzle array component is extracted by reading the recorded medium of the test recording by, for example, a scanner.

Next, in the conventional control method, as a control of the recording density of the nozzle array component adjacent to the reference nozzle array component, the recording density is controlled so that the recording density at the connection matches that of the reference nozzle array component.

In addition, in the conventional control method, test recording and scanner reading of the recording density of the nozzle array component adjacent to the controlled nozzle array component are repeated, and the recording density is controlled so that the recording density at the connection matches with the controlled nozzle array component.

Therefore, in the conventional control method, as a method for sequentially controlling an adjacent nozzle array component so as to match the recording density, the recording density on the recording medium needs to be extracted by test recording at the same number of times as the number of connections of the nozzle array components (N−1 times).

Next, the recording-density control method of the present invention is explained with reference to FIG. 4A.

The recording-density control method of the present invention first determines a driving parameter for driving the second nozzle array component on the basis of the recording density on the recording medium. This is determined upon the connection of a reference nozzle array component of nozzle array components (the first nozzle array component in FIG. 4A) with the second nozzle array component adjacent to the first nozzle array component.

Next, the recording-density control method of the present invention estimates the recording density of the edge of the driven second nozzle array component adjacent to the third nozzle array component on the basis of the determined driving parameter, and determines a driving parameter of the third nozzle array component for matching the recording density of the edge of the third nozzle array component adjacent to the second nozzle array component with the estimated recording density.

In the same manner, the recording-density control method of the present invention estimates the recording density of the $n^{th}$ ($2 \leqq n < N$) nozzle array component driven by a driving parameter of the determined $n^{th}$ nozzle array component at the edge that is adjacent to the $n+1^{th}$ nozzle array component, and determines a driving parameter of the $n+1^{th}$ nozzle array component for matching the recording density of the edge of the $n+1^{th}$ nozzle array component with the estimated recording density at the edge that is adjacent to the $n^{th}$ nozzle array component.

In particular, the recording density control is performed as described below.

First, the recording-density control method performs test recording on a recording medium via all nozzle array components (N number of nozzle array components in FIG. 4A) of an image recording apparatus on the basis of image data with a uniform color and the same tone.

Next, the recording-density control method reads the recording medium having the test recording by, for example, a scanner, calculates the amount of correction needed to match the recording density of the left edge of the second nozzle array component with the recording density of the right edge of the first nozzle array component, from the difference in the recording densities between the right edge of the first nozzle array component and the left edge of the second nozzle array component, and determines a driving parameter of the second nozzle array component that is suitable for the amount of correction (application voltage/application time for each nozzle array component).

Next, the recording-density control method estimates the recording density at the right edge of the second nozzle array component driven by the determined driving parameter.

Afterwards, the recording-density control method determines a driving parameter of the third nozzle array component from the estimated recording density at the right edge of the second nozzle array component.

With the above procedures, the above-explained test recording by all nozzle array components (N nozzle array components) of the image recording apparatus, on the basis of image data with a uniform color and the same tone, and the reading of the recording medium having the test recording performed by a scanner is performed only once . Therefore, it is possible to perform, within a short time period, the recording density control of each of adjacent nozzle array component of an image recording apparatus having nozzle array components.

Figure 4B:
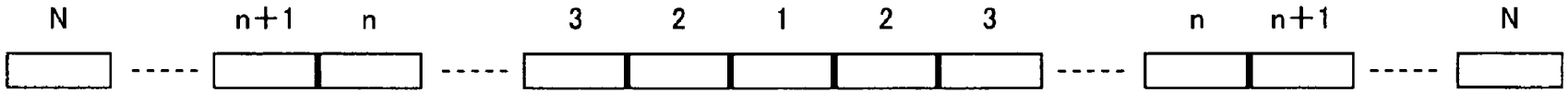
Figure 4C:
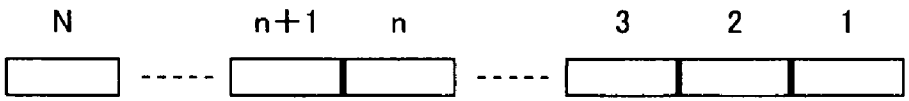

It should be noted that in FIG. 4A, the first nozzle array component serving as a reference is placed on the left; however, the embodiment of the present invention is not limited to such a configuration. It is possible to perform the same recording density control with whichever nozzle array component that is placed in the center defined as the first nozzle array component and serving as a reference, as shown in FIG. 4B, or with the nozzle array component placed on the right defined as the first nozzle array component and serving as a reference, as shown in FIG. 4C.

Figure 5:
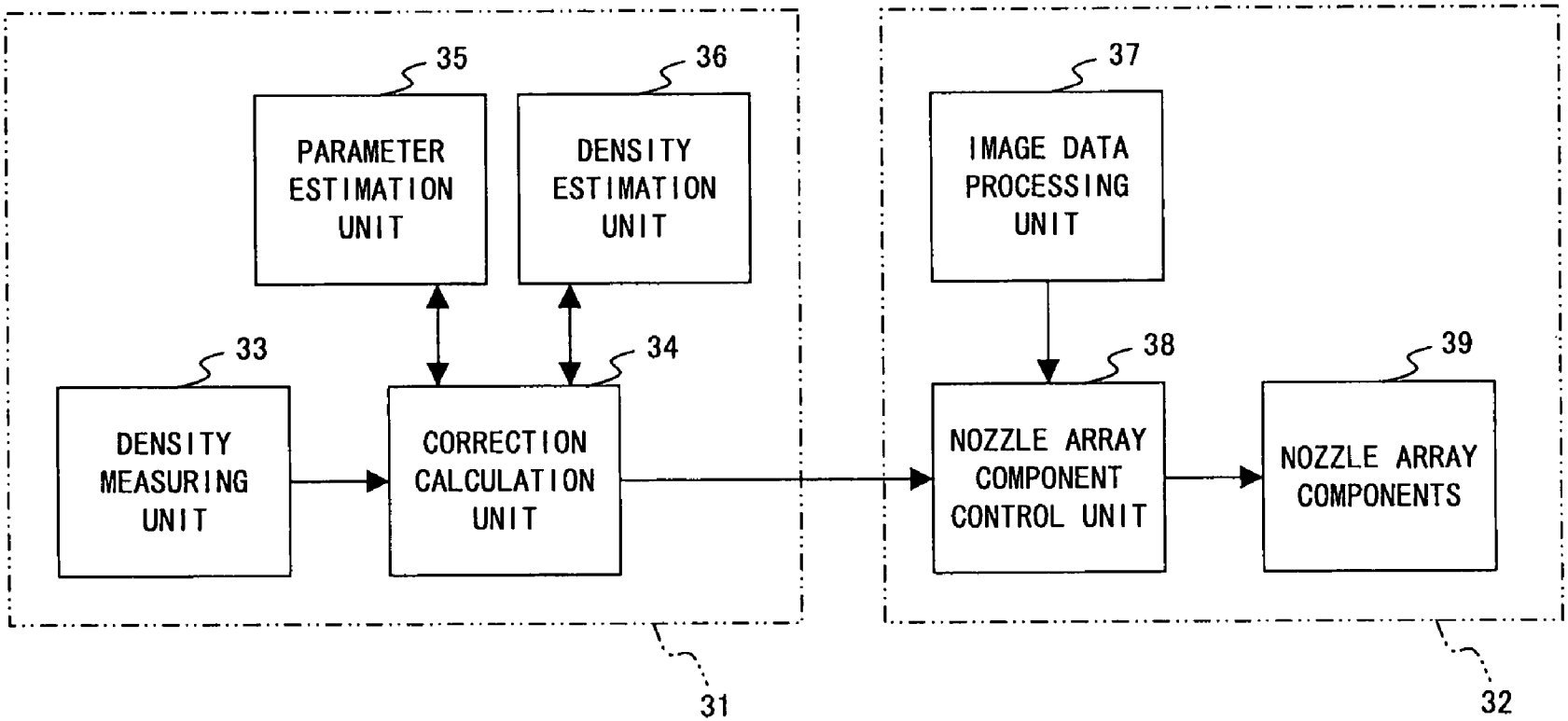
FIG. 5 is a diagram showing the configuration of the density controller and the configuration of the image recording apparatus of the present embodiment.

FIG. 5 shows the configuration of a density controller and the configuration of the image recording apparatus in the recording-density control method of the present embodiment.

A density controller 31 in the recording-density control method of the present embodiment comprises, at minimum, a density measuring unit 33, a correction calculation unit 34, a parameter estimation unit 35 and a density estimation unit 36.

An image recording apparatus 32 to which the density controller 31 is connected comprises, at minimum, an image data processing unit 37, a nozzle array component control unit 38, and nozzle array components 39.

The density measuring unit 33 may have a scanner or a similar device or may be connected to a scanner or a similar device, measures and quantifies the density (or brightness) of a prescribed portion of the recording medium having the test recording (which is to be a measured object explained later), and outputs the measured and quantified value to the correction calculation unit 34 as a density valley (density data). The correction calculation unit 34 obtains a driving parameter such as correction voltage for each nozzle array component by using the parameter estimation unit 35 and the density estimation unit 36 on the basis of the density value input from the density measurement unit 33. The correction calculation unit 34 includes a memory function in addition to a calculation function, and as shown in FIG. 12A described later, data of the density value on the left and correction voltage and the density value on the right of each nozzle array component are stored. The parameter estimation unit 35 calculates a driving parameter, such as correction voltage, that is necessary for recording a prescribed density characteristic. The density estimation unit 36 estimates the recording density corresponding to a certain driving parameter.

The image data processing unit 37 of the image recording apparatus 32 performs processing (such as tone conversion and color conversion) that is necessary for recording to a recording medium; this processing is of the image data input from a host computer or other such device, not shown in the drawing, that is connected to the image recording apparatus 32, and afterwards outputs the data to the nozzle array component control unit 38.

The nozzle array component control unit 38 records the image data input from the image data processing unit 37 on a recording medium by controlling nozzle array components 39 on the basis of the driving parameter input from the correction calculation unit 34. Nozzle array components 39 are a plurality of nozzle array components (recording heads) having a plurality of nozzles being arranged in an approximately orthogonal direction with respect to the direction in which a recording medium is carried, and they record the image data in the recording medium on the basis of an instruction from the nozzle array component control unit 38.

Note that it is possible to have a configuration such that the density controller 31 shown in FIG. 5 can be connected to the image recording apparatus 32 only when extracting a driving parameter for recording density control of nozzle array components 39, and the extracted driving parameter is stored in advance in the nozzle array component control unit 38 and is operated.

Alternatively, it is also possible to have a configuration such that the density controller 31 shown in FIG. 5 is incorporated into the image recording apparatus 32, and a controller unit not shown in the drawing comprising a CPU and other elements in, for example, the image recording apparatus 32 controls and operates each of the components comprising the image recording apparatus 32 and the density controller 31.

The parameter estimation unit 35 and the density estimation unit 36 individually store or share the data indicating a relationship between the driving parameter and the density.

The present embodiment shows an example of a case in which a voltage to be added to a predetermined head driving voltage is used as the driving parameter; this voltage is hereinafter referred to as correction voltage V. The variable range of the correction voltage V is from −2.0V to +2.0V, and the recording density of the image data recorded on the recording medium is high when the correction voltage V is high.

The relationship between the correction voltage V and the scanner output value varies by each nozzle array component of nozzle array components (recording heads). Consequently, when the relationship between, for example, the correction voltage V and the scanner output value for three nozzle array components is indicated in a graph, the graph should appear as it is shown in FIG. 6.

Figure 6:
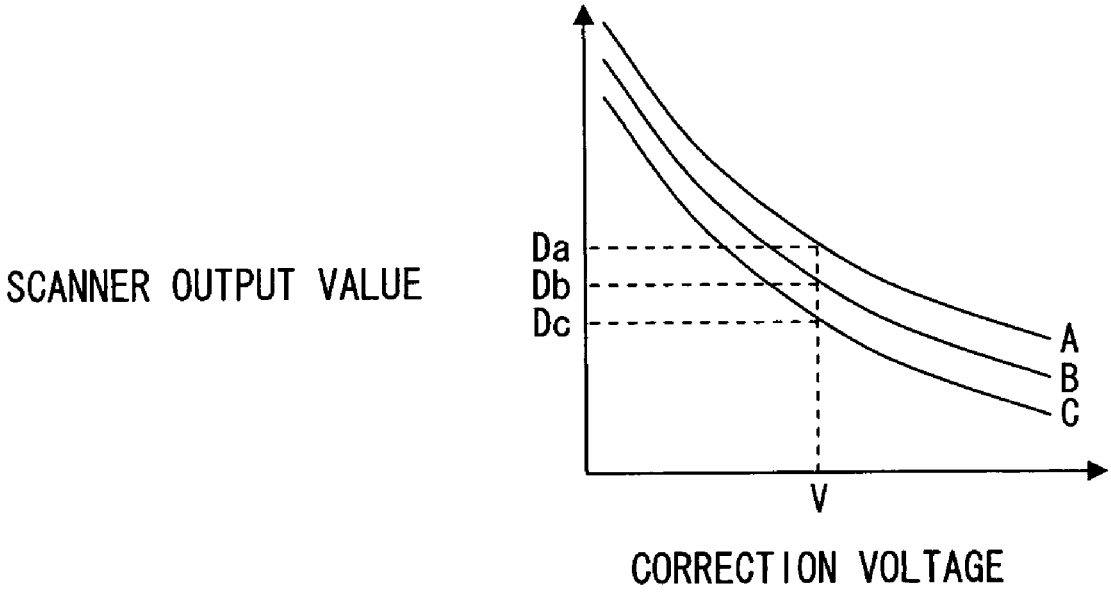
FIG. 6 is a diagram showing the relationship between the correction voltage and the scanner output value with respect to the three nozzle array components.

As shown in the graph in FIG. 6, the relationship between the correction voltage and the scanner output value for the three nozzle array components appears as A, B and C in the graph. The scanner output values with respect to a correction voltage V, for example, are different depending on the nozzle array component, as shown with Da, Db, and Dc.

The driving parameter is calculated from an average characteristic that is based on the relationship that exists when the correction voltage V is changed from −2.0V to +2.0V for nozzle array components. As a result, for the driving parameter, data showing the relationship between the correction voltage V and the scanner output value as shown in FIG. 7, for example, can be obtained.

The parameter estimation unit 35 and the density estimation unit 36 of the density controller 31 of FIG. 5 explained above store the data showing the relationship, and estimate the driving parameter or the recording density with reference to the data as necessary.

In the following description, the operation processing of the parameter estimation unit 35 is explained with reference to FIG. 8. Curve 41 shown in FIG. 8 corresponds to the data of FIG. 7, and indicates an average characteristic curve of the scanner output value when the value of the measured value of the correction voltage V is changed for nozzle array components. Curve 42 indicates the characteristic of the nozzle array component, the driving parameter of which is to be estimated by the parameter estimation unit 35.

The parameter estimation unit 35, by using curve 41, estimates, from the scanner output value D1 at the time when the correction voltage is V1, a correction voltage V2 at which the scanner output value becomes D2.

Such a parameter estimation method first obtains an intersection Pa of the curve 41 and a line perpendicular to a point P1 where the correction voltage is V1 and the scanner output is D1. Next, the parameter estimation method obtains a distance between the point P1 and Pa, which is D1−Da. The parameter estimation method, afterwards, obtains Db at a position distant from D2 by the obtained distance, and finally obtains a point where the scanner output value is Db on the curve 41, which is to be the correction voltage V2 corresponding to Pb as an estimated value.

In this example, the characteristic curve of each nozzle array component is estimated under the assumption that the average characteristic curve of nozzle array components is moved in parallel in a perpendicular direction. The curve 42 of FIG. 8, for example, is estimated under the assumption that the average characteristic curve 41 is moved upward in parallel on the plane of the drawing.

It should be noted that the estimation method that uses the parameter estimation unit 35 in the present embodiment is not limited to the above method; however, it is also possible to estimate by considering a correction value obtained by adding a parameter value to the average characteristic curve, for example, by multiplying a parameter value or by adding a particular correction such as the synthesizing with other characteristic curves, as a characteristic curve of the nozzle array component.

Next, the operation processing of the density estimation unit 36 is explained with reference to FIG. 9.

Figure 8:
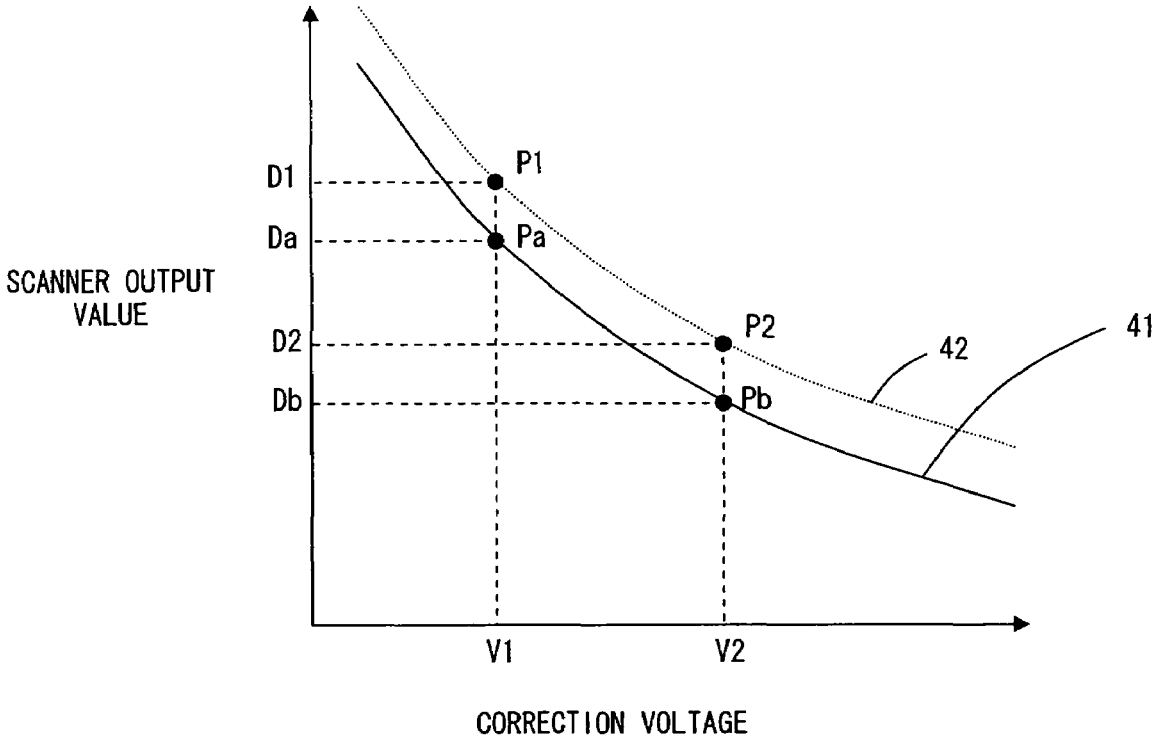
FIG. 8 is a diagram for explaining the operation of the parameter estimation unit.

Curve 51 is a scanner output value that exists when the correction voltage value corresponding to the data of FIG. 7 is changed in the same manner as curve 41 of FIG. 8, and indicates an average characteristic curve of the measured value from nozzle array components. Curve 52 indicates a characteristic of the nozzle array component that the density estimation unit 36 designates as an estimation subject of the recording density.

In order to estimate the recording density with the density estimation unit 36, a scanner output value D2 when the correction voltage is V2 are estimated from a scanner output value D1 when the correction voltage is V1.

The density estimation unit 36 first obtains an intersection Pa where the curve 51 intersects with a line drawn perpendicularly downward from a point P1 where the correction voltage is V1 corresponding to the scanner output value D1 on the curve 52.

Next, the density estimation unit 36 obtains the distance from P1 to Pa, which is the same as the distance from D1 to Da.

Next the density estimation unit 36 obtains a point where the correction voltage is V2 on the curve 51, and this point is Pb.

Next, the density estimation unit 36 estimates the scanner output value D2 by adding the distance from Da to D1 to the scanner output value Db of the obtained Pb.

It should be noted that the estimation of the recording density by the density estimation unit 36 is performed under the assumption that the characteristic curve of each nozzle array component as explained above is the average characteristic curve moved in parallel in a perpendicular direction; however, the estimation method carried out by the density estimation unit 36 in the present embodiment is not limited to the above method. For example, the average characteristic curve that has a particular correction value added to it or that is multiplied by a correction value is considered to be a characteristic curve of the nozzle array component for the estimation.

Next, details of the recording-density control method of the image recording apparatus in the first embodiment of the present invention are explained with reference to the operation processing flowchart shown in FIG. 10.

Note that in the explanation of the present control method, in order to simplify the explanation, it is assumed that one nozzle array component (recording head) comprises three nozzle array components (recording heads). The estimation is performed under the assumption that each of the nozzle array components has a density characteristic that shows the average characteristics curve on the basis of the average in FIG. 7 being moved vertically in parallel.

Figure 10:
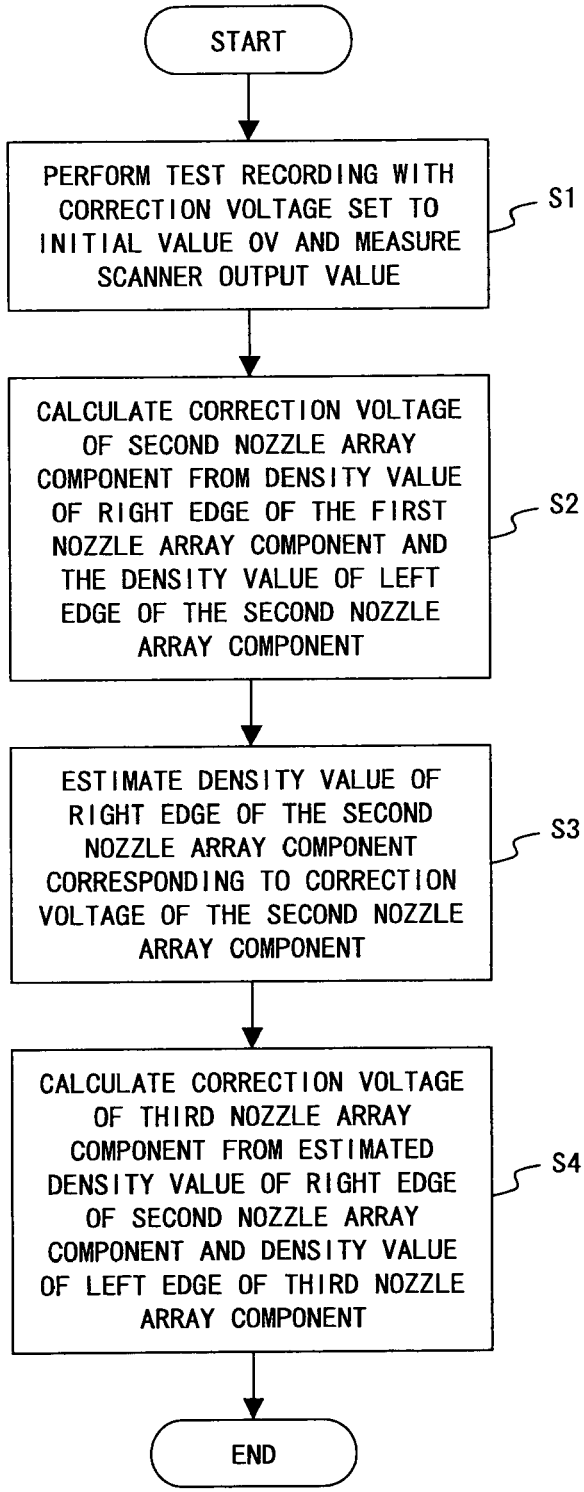
FIG. 10 is a flowchart showing the operation processing procedure of the recording-density control of the image recording apparatus in the first embodiment of the present invention.

In step S1 of the control method, when the processing of FIG. 10 is started, test recording is performed by setting the correction voltages of three nozzle array components to an initial value of 0V.

Figure 11:
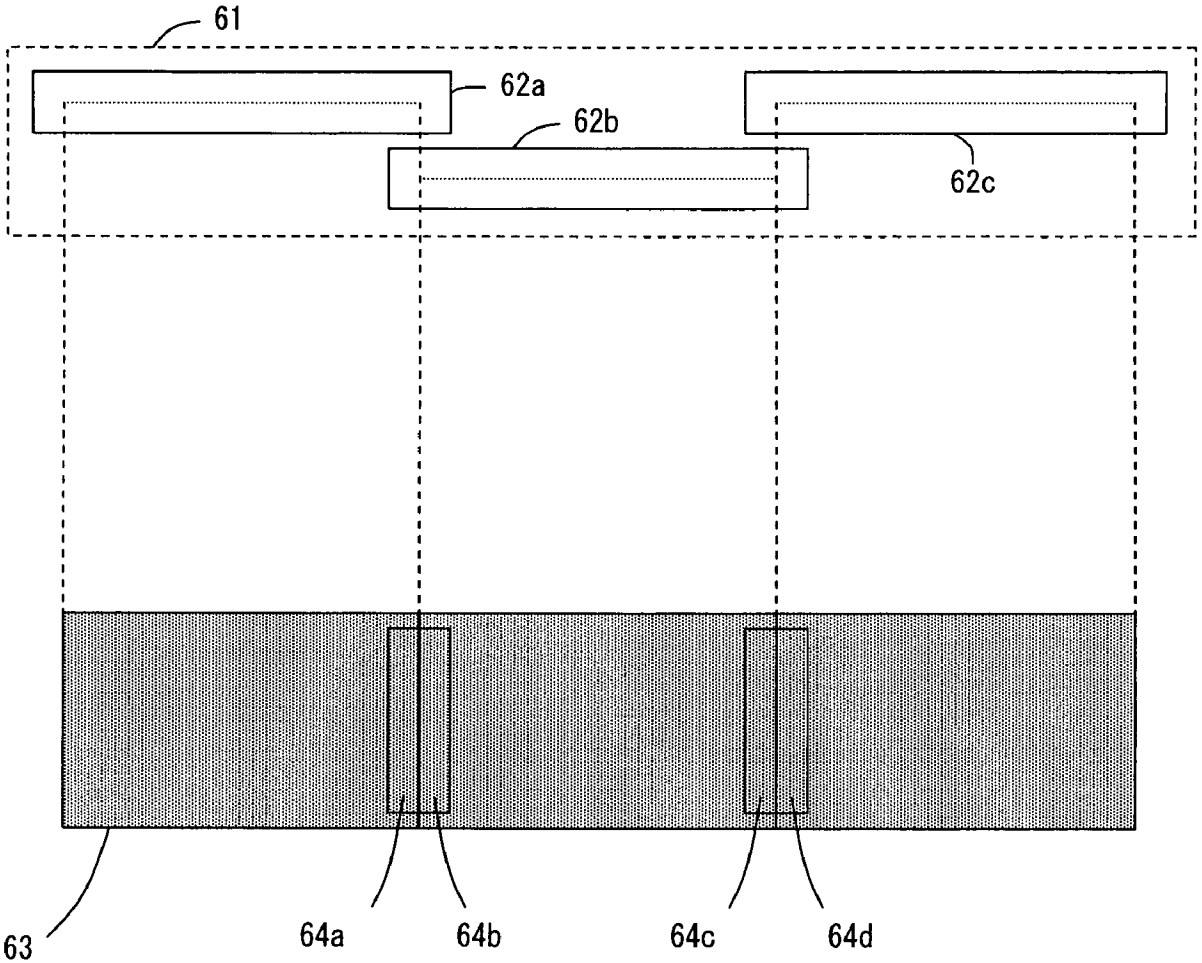
FIG. 11 is a diagram showing the measured image recorded in the recording medium in the test recording.

A measured image recorded in a recording medium in the test recording is shown as an image 63 in FIG. 11, and it is a recorded image (a solid image) recorded with a certain tone and at the width of a nozzle array component (recording head) 61.

To attain the certain tone, one tone is selected appropriately from tones such as the highest recordable tone or a middle tone.

The density measuring unit 33 in FIG. 5, using an image reading apparatus such as a scanner, measures the density of areas near the nozzle array component connection portion (64*a*-64*d* of FIG. 11) that record a portion of the edge of the nozzle array components 62*a*-62*c* of the output measured image.

Note that the value output by the scanner represents brightness in general, and it is an inverted value of the density; however, it is assumed in the following description that the output of the scanner represents the density.

The densities of the areas 64*a*-64*d* near the nozzle array component connection portions are represented by one numerical value using the average value of the areas. For example, when using a scanner obtaining values within the range of 0 to 255 as the density of each area, a numerical value between 0 and 255 is determined as the density of each area. The numerical values are stored in the correction calculation unit 34 of FIG. 5.

FIG. 12 shows, for each of the nozzle array components stored in the correction calculation unit 34, density value data on the left and the correction voltage and a density value on the right. Note that FIG. 12 shows a case in which a nozzle array component (recording head) comprises three nozzle array components as an example; however, in a case in which a nozzle array comprises N number of nozzle array components, the correction calculation unit 34 stores the data of N number of nozzle array components.

The items "density value on the left" and "density value on the right" indicated in FIG. 12A correspond to the scanner output value stored in the correction calculation unit 34 in step S1.

It should be noted that the following description assumes that the density values are values as shown in FIG. 12A.

Note that the above-explained measured image may not be an image recorded on the whole surface of the recording medium like image 63 of FIG. 11; however, it can be an image recording the portion necessary for density measurement, that is, an image recording the proximity of the areas 64*a*-64*d* to the nozzle array component connections.

Next, in step S2 of the control method, the three nozzle array components constituting a nozzle array component (recording head) as, from the left, the first nozzle array component, the second nozzle array component, and the third nozzle array component; and, by using the density value of the right edge of the first nozzle array component and the density value of the left edge of the second nozzle array component, the parameter estimation unit 35 calculates and determines the correction voltage of the driving parameter of the second nozzle array component needed to match the density value of the left edge of the second nozzle array component with the density value of the right edge of the first nozzle array component.

In FIG. 12A, the density value of the right edge of the first nozzle array component is 68.5, the density value of the left edge of the second nozzle array component is 70.4, and the initial value of the correction voltage of the second nozzle array component is 0V.

Accordingly, in FIG. 8, V1=0, D1=70.4, and D2=68.5.

From the table in FIG. 7, it is also obtained that Da=70. 6.

Consequently, Db=D2+(Da−D1)=68.5+(70.6−70.4)=68.7 is obtained.

The parameter estimation unit 35 in the control method, with reference to the table in FIG. 7, obtains the correction voltage of the second nozzle array component as V2=0.5V by obtaining the correction voltage where the scanner output value is 68.7.

Next, in step S3 of the control method, the density value of the right edge of the second nozzle array component corresponding to the correction voltage of the second nozzle array component obtained in step S2 is estimated using the density estimation unit 36.

It is obtained from FIG. 12A that the initial value of the correction voltage is 0V, the density value of the right edge of the second nozzle array component at that time is 67.9, and from the result of step S2, the correction voltage after the correction is 0.5V.

Figure 9:
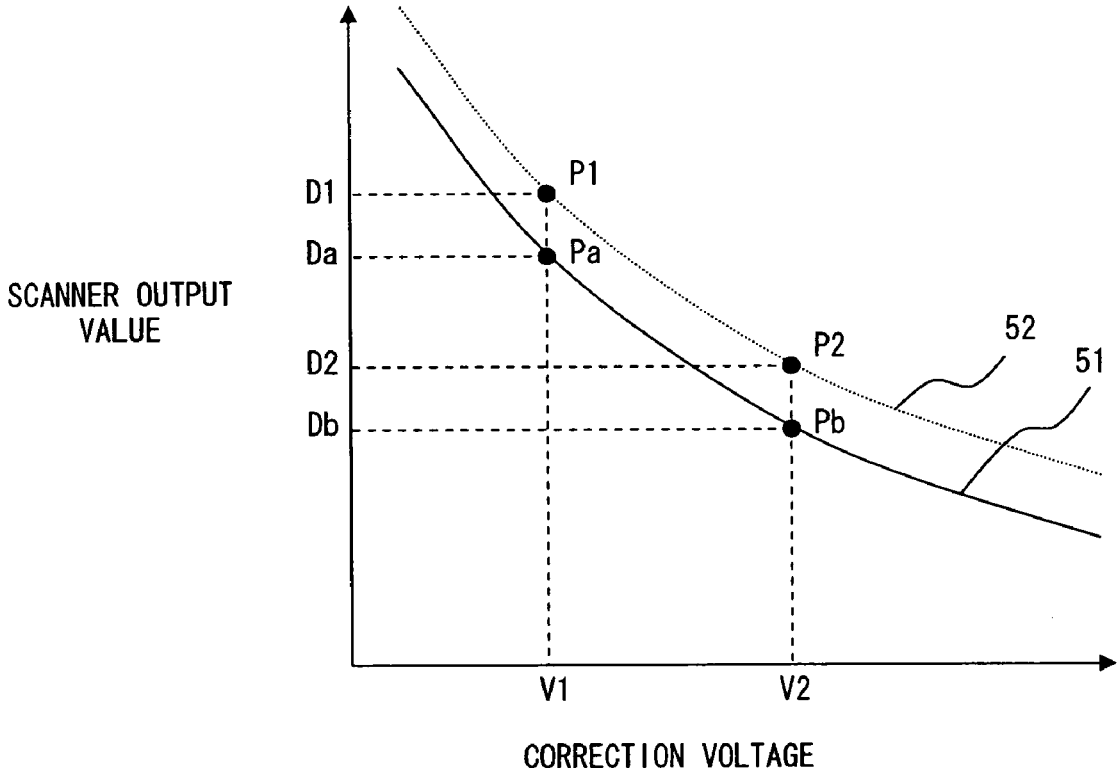
FIG. 9 is a diagram for explaining the operation of the density estimation unit.

Accordingly, in FIG. 9, V1=0, D1=67.9, and V2=0.5 are obtained. From the table in FIG. 7, it is obtained that Da=70.6 (V=0.0) and Db=68.7 (V=0.5).

Consequently, D2=Db+(D1−Da)=68.7+(67.9−70.6)=66.0 is obtained. In other words, the density estimation unit 36 of the control method estimates the density value of the right edge of the second nozzle array component to be 66.0 when the correction voltage is 0.5V.

When the correction voltage and the density value at the right and left edges of the second nozzle array component are replaced with an estimated value, the data in FIG. 12A is converted to the data shown in FIG. 12B.

Next, in step S4 of the control method, by using the parameter estimation unit 35 on the basis of the estimated density value of the right edge of the second nozzle array component at the correction voltage of 0.5V and the density value of the left edge of the third nozzle array component, the correction voltage of the driving parameter of the third nozzle array component for matching the density value of the left edge of the third nozzle array component with the density value of the right edge of the second nozzle array component is calculated and determined.

It is obtained from FIG. 12B that the estimated density value of the right edge of the second nozzle array component at the correction voltage of 0.5V is 66.0, the density value of the left edge of the third nozzle array component is 71.1, and the initial value of the correction voltage of the third nozzle array component is 0V.

Accordingly, in FIG. 8, V1=0, D1=71.1, and D2=66.0 are obtained. It is also obtained, on the basis of the table in FIG. 7, that Da=70.6 (V=0.0).

Consequently, Db=D2+(Da−D1)=66.0+(70.6−71.1)=65.5 is obtained. The parameter estimation unit 35 in the control method estimates, with reference to the table in FIG. 7, the correction voltage as V2=approximately 1.5V where the scanner output value D is 65.5.

When the correction voltage and the density value of the left edge of the third nozzle array component are replaced with the estimated values, the data in FIG. 12B is converted to the data in FIG. 12C.

As a result, the correction voltages of the second nozzle array component and the third nozzle array component can be controlled by the first test recording alone.

It should be noted that the above example provides a case in which a nozzle array component (recording head), over the width of the recording medium, comprises three nozzle array components; however, in a case in which the nozzle array component comprises more nozzle array components (recording heads), the reduction effect of the control time becomes prominently apparent.

As explained above, according to the recording-density control method of the image recording apparatus in the first embodiment of the present invention, even for a recording-density control method of an image recording apparatus with a plurality of nozzle array components, only an initial test recording of the N number of nozzle array components (N is an integer in which N≧3) arranged in a multiple number is required to perform recording density control; this is done by determining a driving parameter for driving the second nozzle array component from the density values of the first nozzle array component serving as a reference and the second nozzle array component adjacent to the first nozzle array component, estimating the recording density of the edge adjacent to the $n+1^{th}$ nozzle array component side of the $n^{th}$ nozzle array component (n is an integer in which n≧2) from among the N number of nozzle array components driven by the driving parameter, and determining a driving parameter of the $n+1^{th}$ nozzle array component on the basis of the estimated recording density of the edge.

Next, the recording-density control method of the image recording. apparatus in the second embodiment of the present invention is explained.

The second embodiment, compared with the above first embodiment, is a recording-density control method of the image recording apparatus having a configuration such that an array of a plurality of complex nozzles (complex recording heads) comprises nozzle array components (recording heads) that are arranged over the width of a recording medium and are shifted by half of a standard dot pitch (a nozzle formation pitch) in the width direction of the recording medium so that they may be placed in their correct positions.

Figure 13:
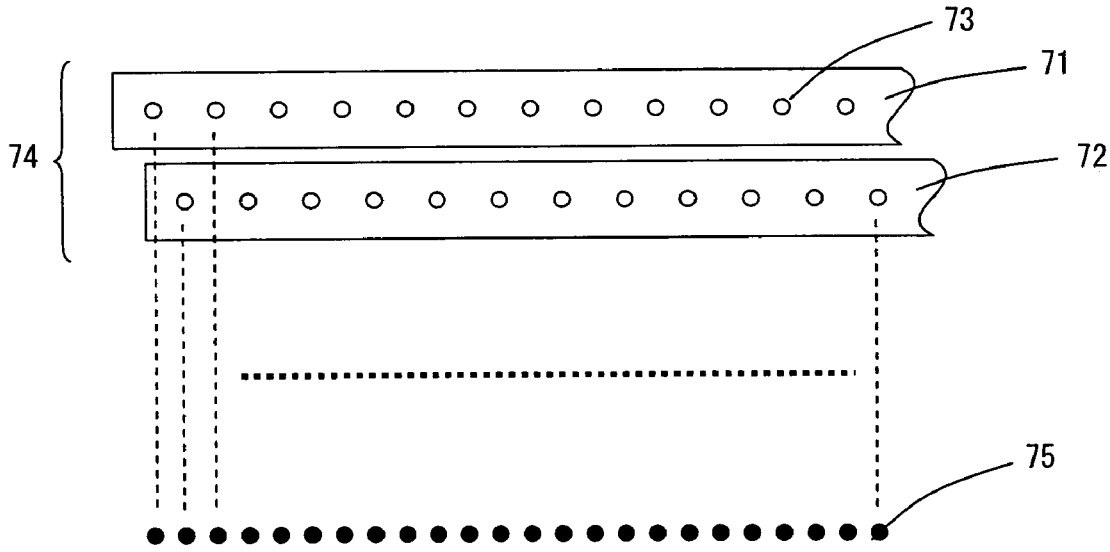
FIG. 13 is a diagram showing the structure of the complex recording head and recording dots recorded by the complex recording head.

FIG. 13 shows the configuration of the complex recording head for recording with a recording density of twice the normal density by using two recording heads, the positions of which are shifted from each other by half of the standard dot pitch.

In FIG. 13, recording head 71 and recording head 72 are, as an example, arranged by shifting the positions by a half of a formation pitch of the plurality of nozzles (ink discharge holes) 73, or are bound by shifting the position from each other.

It should be noted that such a complex recording head for recording with a recording density of twice the normal density is not limited to configurations in which the positions of the recording heads are arranged so as to be shifted from each other or are bound so as to be shifted from each other. However, it is possible, for example, to have a recording head with a plurality of nozzle array components, each of which comprises a plurality of nozzles of the recording head 71 and the recording head 72 is formed by shifting the positions form each other by a distance corresponding to a half of the nozzle formation pitch.

In the following description, a complex recording head having recording head 71 and recording head 72 arranged in the positions shifted from each other, or bound in the position shifted from each other by a distance corresponding to half of the nozzle formation pitch, is referred to as a complex recording head 74.

Recording dots 75 recorded by the complex recording head 74 are shown schematically in FIG. 13.

If recording head 71 and recording head 72 are correctly arranged by shifting the position from each other or correctly bound by shifting the position from each other by a distance corresponding half of the nozzle formation pitch, as shown in FIG. 13, the dot intervals of the recording dots 75 should be constant. However, in reality the positions of the dot intervals of the recording dots 75 deviate due to various factors, and are sometimes not constant.

Figure 14:
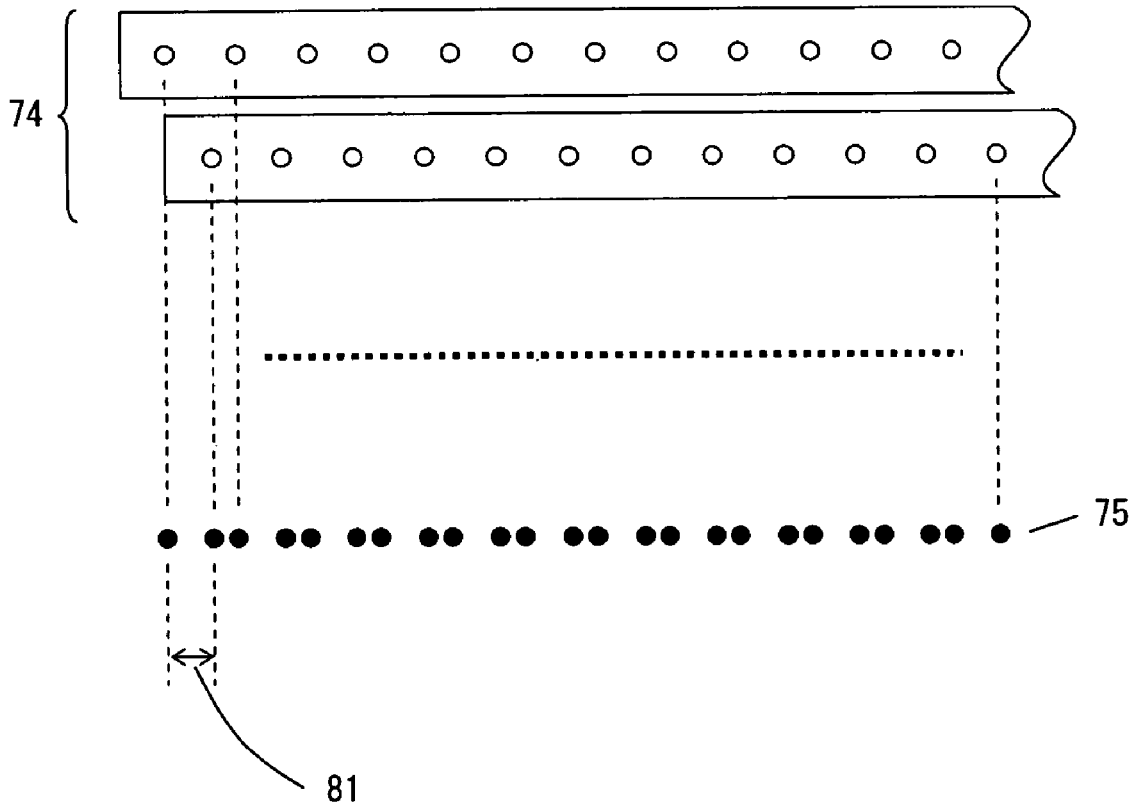
FIG. 14 is a diagram showing a complex recording head having unequal dot intervals.

FIG. 14 shows a state in which the dot intervals are unequal due to the position deviation of the arrangement between the recording head 71 and the recording head 72 or bound between the recording head 71 and the recording head 72.

The recording dots 75 shown in FIG. 14 have unequal dot intervals 81, and depending on the size of the dot intervals 81, the recording density characteristic changes.

Figure 15:
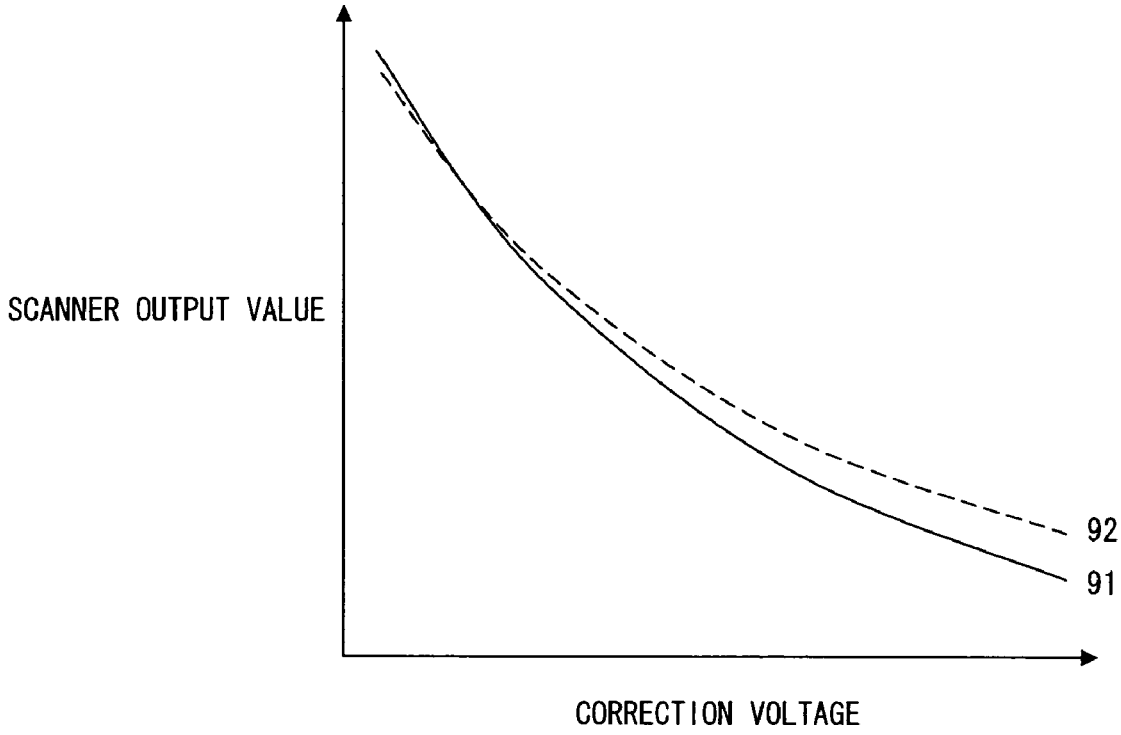
FIG. 15 is a diagram showing an example in which the recording density characteristic changed due to the unequal dot intervals.

FIG. 15 shows an example in which the recording density characteristic changed due to the unequal dot intervals 81 as shown in FIG. 14.

The change in the recording density characteristic can be represented by, for example, curve 91 in a case in which the dot intervals 81 between the recording head 71 and the recording head 72 are equally spaced (correctly controlled in positions of a half of the nozzle pitch), and the recording density characteristic changes as represented by curve 92 in a case in which the dot intervals 81 are unequal (are deviated from their positions at a half of the nozzle pitch).

In the control method of the second embodiment, the density characteristic data shown in FIG. 7 for each of a plurality of conditions in which the sizes of the dot intervals 81 are different is created in advance.

The parameter estimation unit 35 and the density estimation unit 36 estimate recording density by using the density characteristic data (data shown in FIG. 7) created with dot intervals that have the greatest similarity to the dot intervals recorded on the recording medium by the complex recording head 74 which is a subject for controlling a parameter.

As a result, density control of the recorded image can be performed with a high accuracy by the improvement of the estimation accuracy of the driving parameter and the recording density.

Next, the details of the recording-density control method of the image recording apparatus in the second embodiment of the present invention are explained with reference to the operation processing flowchart shown in FIG. 16.

Figure 16:
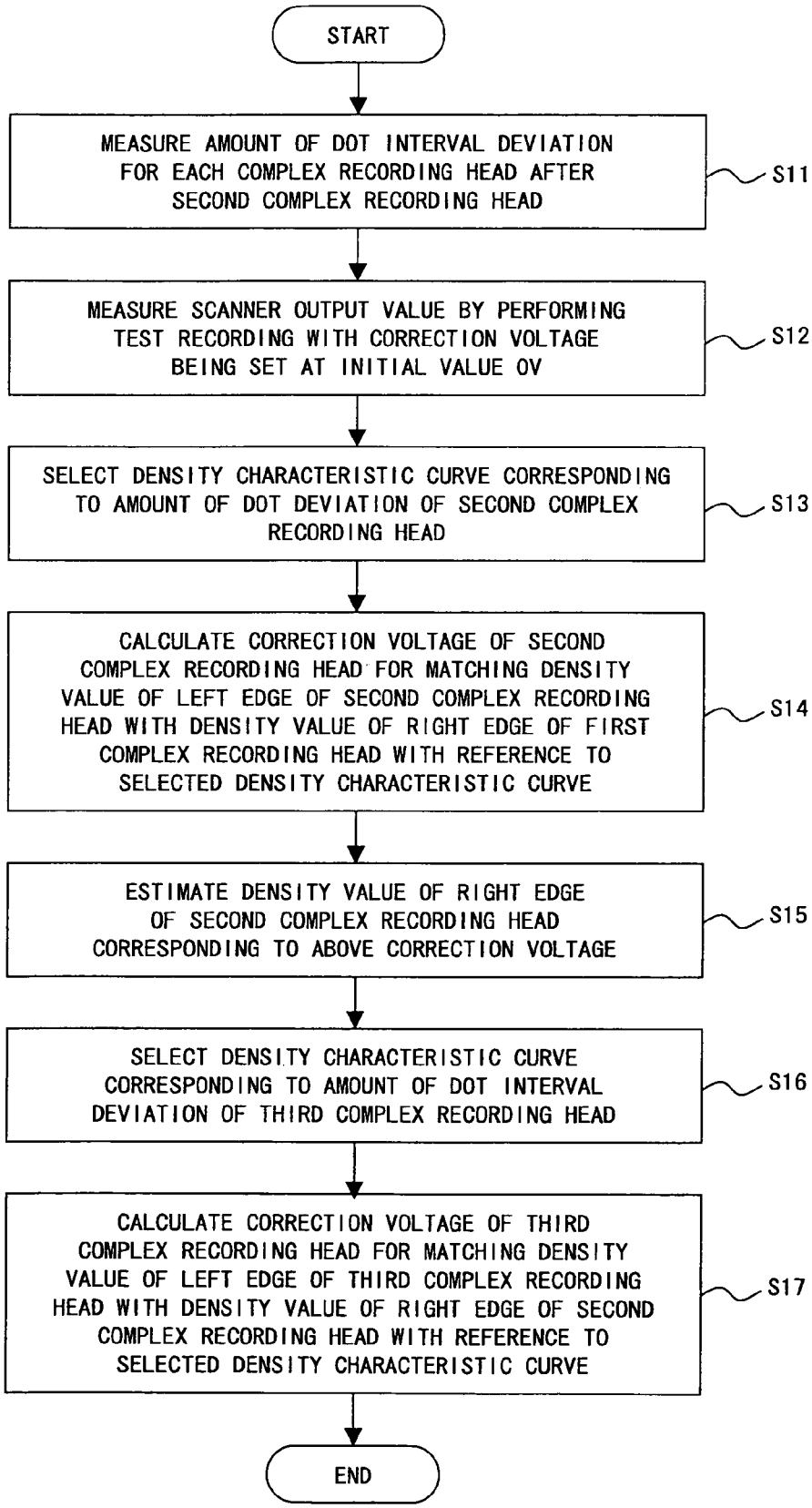
FIG. 16 is a flowchart showing the operation processing procedure of the recording density control of the image recording apparatus in the second embodiment of the present invention.

FIG. 16 is a flowchart showing processing of the density control method in the image recording apparatus in the second embodiment.

It should be noted that for the purpose of simplifying the explanation, the explanation of the present control method is of the recording-density control method of the image recording apparatus with a configuration comprising three complex recording heads (see FIG. 13).

Note that the following description assumes that the complex recording head serving as a reference is the first complex recording head, the complex recording head adjacent to the first complex recording head is the second complex recording head, and the complex recording head not adjacent to the first complex recording head is the third complex recording head.

In step S11 of the control method, when the processing is started in FIG. 16, the amount of deviation of the dot intervals is measured for both the second complex recording head and the third complex recording head.

Next, in step S12 of the control method, test recording is performed by setting the correction voltage of each complex recording head to an initial value of 0V, the recorded measured image is read by a scanner, and the scanner output values of each complex recording head are measured.

Next, in step S13 of the control method, a density characteristic curve corresponding to the amount of the dot interval deviation of the second complex recording head measured in step S11 is selected on the basis of the scanner output value in step S12.

Next, in step S14 of the control method, the correction voltage of a driving parameter of the second complex recording head for matching the density value of the left edge of the second complex recording head with the density value of the right edge of the first complex recording head is calculated and determined with reference to the density characteristic curve selected in step S13.

Next, in step S15 of the control method, using the density estimation unit 36, the density value of the right edge of the second complex recording head corresponding to the correction voltage obtained in step S14 is estimated.

Next, in step S16 of the control method, the density characteristic curve corresponding to the dot interval deviation amount of the third complex recording head measured in step S11 is selected.

In step S17 of the control method, using the parameter estimation unit 35, the correction voltage of a driving parameter of the third complex recording head for matching the density value of the left edge of the third complex recording head with the density value of the right edge of the second complex recording head is calculated and determined with reference to the selected density characteristic curve.

As explained above, according to the recording-density control method of the image recording apparatus in the second embodiment of the present invention, even in a recording-density control method of an image recording apparatus with a plurality of complex recording heads having two recording heads or two nozzle array components arranged by shifting the positions from each other or bound by shifting the positions from each other by a distance corresponding to a half of the nozzle formation pitch, only an initial test recording to the N number of nozzle array components (N is an integer in which N≧3) arranged in a multiple number is required to perform recording density control; this recording density control is performed by selecting a density characteristic curve on the basis of the amount of deviation of the dot intervals of each complex recording head, by determining driving parameters for driving the first complex recording head serving as a reference and the second complex recording head adjacent to the first complex recording head with reference to the selected density characteristic curve of the second complex recording head, by estimating the recording density of the edge adjacent to the $n+1^{th}$ complex recording head side of the $n^{th}$ complex recording head (n is an integer in which n≧2) among the N number of complex recording heads driven by the driving parameter, and by determining a driving parameter of the $n+1^{th}$ nozzle array component on the basis of the estimated recording density of the edge with reference to the selected density characteristic curve of the $n+1^{th}$ complex recording head.

It should be noted that in the above first embodiment and second embodiment, the driving parameter is the driving voltage of the recording head; however, instead of the driving voltage, it is possible to use the voltage application time as a driving parameter. It is also possible to have a configuration such that both the driving voltage and the voltage application time are used as the driving parameters.

The above first embodiment and second embodiment are explained with an example of an inkjet recording image recording apparatus; however, in addition to the inkjet image recording apparatuses, the present embodiment can be applied to other image recording apparatuses such as a thermal image recording apparatus that uses a line head in which the recording density changes at the edge due to the thermal characteristic.

What is claimed is:

1. A recording-density control method of an image recording apparatus for performing image recording by arranging, in a direction approximately orthogonal to the direction in which a recording medium is carried, a nozzle array component comprising a plurality of nozzles for discharging uniform-color ink, comprising:

performing test recording on the recording medium by an N number (where N is an integer in which N≧3) of the nozzle array components arranged in a plural number;

determining, as a control of a second nozzle array component adjacent to a first nozzle array component, and on the basis of the first nozzle array component serving as a reference in the N number of nozzle array components, a driving parameter for the driving of the second nozzle array component from a recording density of the recording medium that is used for the test recording by nozzles located at contact edges of the first and second nozzle array components;

estimating a recording density of an edge of an $n^{th}$ nozzle array component (where n is an integer in which n≧2) that is in contact with the $n+1^{th}$ nozzle array component side among the N number of nozzle array components driven by the determined driving parameter; and determining a driving parameter for driving the $n+1^{th}$ nozzle array component on a basis of the estimated recording density of the edge.

2. The recording-density control method of an image recording apparatus according to claim 1, wherein when determining the driving parameter in case of comprising a complex nozzle array component having a configuration such that the nozzle array components are arranged by shifting the positions so that they are approximately orthogonal to a direction in which the recording medium is carried, a determining method changes in accordance with an amount of characteristic of the complex nozzle array component.

3. The recording-density control method of an image recording apparatus according to claim 2, wherein the amount of characteristic includes an amount of deviation in dot intervals when the complex nozzle array component performs image recording on the recording medium.

4. The recording-density control method of an image recording apparatus according to claim 2, wherein the driving parameter includes a driving voltage of the nozzle array components that are arranged in a plural number or an amount of correction to the driving voltage.

5. The recording-density control method of an image recording apparatus according to claim 2, wherein the driving parameter includes an application time of a driving voltage of the nozzle array components that are arranged in a plural number or an amount of correction to the application time of the driving voltage.

6. The recording-density control method of an image recording apparatus according to claim 1, wherein the driving parameter includes a driving voltage of the nozzle array components that are arranged in a plural number or the amount of correction to the driving voltage.

7. The recording-density control method of an image recording apparatus according to claim 1, wherein the driving parameter includes the application time of a driving voltage of the nozzle array components that are arranged in a plural number or an amount of correction to the application time of the driving voltage.

8. The recording-density control method of an image recording apparatus according to claim 1, wherein the nozzle array components that are arranged in a plural number comprises a complex nozzle array component with a configuration such that the nozzle array components are arranged by shifting the positions in a direction approximately orthogonal to the direction in which the recording medium is carried.

9. The recording-density control method of an image recording apparatus according to claim 8, wherein the complex nozzle array component has a configuration such that nozzles at the edge of adjacent complex nozzle overlap each other in a direction approximately orthogonal to a direction in which the recording medium is carried.

10. The recording-density control method of an image recording apparatus according to claim 1, wherein the nozzle array components has a configuration such that nozzles at the edge of adjacent nozzle overlap each other in a direction approximately orthogonal to the direction in which the recording medium is carried.

11. The recording-density control method of an image recording apparatus according to claim 1, wherein the driving parameter is determined by, at minimum, the reading of the recording medium used for the test recording by a density controller.

12. The recording-density control method of an image recording apparatus according to claim 11, wherein the density controller includes, at minimum, a scanner.

* * * * *